United States Patent [19]

Duva et al.

[11] 4,401,527

[45] Aug. 30, 1983

[54] PROCESS FOR THE ELECTRODEPOSITION OF PALLADIUM

[75] Inventors: Robert Duva, Paramus; Linda J. Mayer, Denville, both of N.J.

[73] Assignee: Occidental Chemical Corporation, Warren, Mich.

[21] Appl. No.: 294,668

[22] Filed: Aug. 20, 1981

Related U.S. Application Data

[63] Continuation-in-part of Ser. No. 68,134, Aug. 20, 1979, abandoned.

[51] Int. Cl.[3] ..... C25D 3/50

[52] U.S. Cl. ..... 204/47

[58] Field of Search ..... 204/47

[56] References Cited

U.S. PATENT DOCUMENTS

| | | | |
|---|---|---|---|
| 1,993,623 | 3/1935 | Raper | 204/47 |
| 2,067,534 | 1/1937 | Keifel | 204/47 |
| 3,925,170 | 12/1975 | Skomoroski et al. . | |

FOREIGN PATENT DOCUMENTS

| | | | |
|---|---|---|---|
| 350865 | 11/1972 | U.S.S.R. | 204/47 |

*Primary Examiner*—Howard S. Williams

*Attorney, Agent, or Firm*—Richard P. Mueller

[57] ABSTRACT

A process for the electrodeposition of palladium in which palladium is electrodeposited from an aqueous plating bath which contains a bath soluble palladium compound, an electrolyte compound and a nitrite compound in an amount sufficient to provide an excess of free nitrite ions relative to the palladium ions. In a preferred embodiment, the bath also contains a buffering agent to maintain the bath pH at from about 6.5 to 7.5. The electrodeposition is carried out using an insoluble anode, while maintaining the excess of free nitrite ions in the bath relative to the palladium ions. In this manner, the plating efficiency of the bath is maintained at a substantially constant, high level for extended periods of plating at current densities in excess of 10 amps per square decimeter.

5 Claims, No Drawings

PROCESS FOR THE ELECTRODEPOSITION OF PALLADIUM

REFERENCE TO RELATED APPLICATION

This application is a continuation-in-part of U.S. Ser. No. 068,134, filed Aug. 20, 1979, now abandoned.

FIELD OF THE INVENTION

This invention relates to a process for the electrodeposition of palladium on substrates, and more particularly relates to a palladium electrodeposition process which is operable at high current densities while maintaining stable, constant high plating efficiencies.

BACKGROUND OF THE INVENTION

Processes for electrodepositing metal in various thicknesses on substrates, are well known in the art. Typically, an electroplating bath comprising ions of the metal to be deposited and a suitable electrolyte is provided. The article or object to be plated is immersed in or otherwise contacted with the bath while connected as the cathode to an external current source, and a metal electrode is connected as the anode to the same current source. During operation, ions of the metal to be deposited are reduced in the bath to zero valance metal which plates out on the workpiece surface.

Special mention is made of methods for electrodepositing metallic palladium on substrates, particularly metallic surfaces. In such cases, the palladium deposition bath tends to be unstable and cannot be used continuously for extended periods without undergoing significant losses in bath efficiency. The term "bath efficiency" herein refers to the comparison at a given current density between the actual bath plating rate and the theoretical bath plating rate as determined mathematically from Faraday's Law.

Although conventional palladium electrodeposition baths may display good efficiency initially and shortly after plating has begun, this efficiency often decreases sharply within a few hours, and in some cases dropping off to less than 50% of the original value after only about twenty-four hours of continuous use. To maintain the palladium plating rate at or reasonably near original levels, it is usually necessary to supply a higher current to the plating bath, a procedure which will produce unsatisfactory electrodeposits.

Without wishing to be bound by any theory, it is believed that the palladium ions in the bath are oxidized to higher valence states during operation, thus making it more difficult to reduce the palladium ions to metallic palladium and plate out without supplying more current to the bath. The problem of unstable plating efficiencies is recognized in the art. For example, U.S. Pat. No. 4,092,225 states that a rapid decrease in cathode efficiency occurs at current densities in excess of about 4 amps per square decimeter. In additional published data on palladium plating systems, the development of erratic cathode efficiencies as the plating bath ages during use is described. See "Precious Metal Plating" by Fischer and Weiner (1964) Page 203 and U.S. Pat. No. 1,779,436.

OBJECTS OF THE INVENTION

It is, therefore, an object of this invention to provide electrodeposition techniques that are capable of depositing metallic palladium at substantially constant bath efficiencies for extended periods of use.

It is a further object of this invention to provide improved methods for electrodepositing metallic palladium from an aqueous deposition bath at relatively high current densities while maintaining high substantially constant plating efficiencies.

These and other objects, which will be apparent from the following description, are achieved by practice of the invention now described.

SUMMARY OF THE INVENTION

The compositions for use in the process of the invention, briefly, described, comprise an aqueous solution of a water soluble palladium compound capable of dissociating in water to provide palladium ions, an electrolyte compound and a source of free nitrite ions in an amount capable of providing a stoichiometric excess of nitrite ions relative to the palladium ions. Additionally, the plating bath may contain a suitable buffer to stabilize and maintain the pH of the solution within the range of about 6.5 to 7.5.

Electrodeposition of palladium from this bath is effected by passing an electric current through the bath between the substrate to be plated, as the cathode, and an insoluble anode, while maintaining a stoichiometric excess of nitrite ions in the bath, relative to the palladium ions. In this manner, electroplating may be carried out for extended periods of time, even at current densities in excess of 10 amps per square decimeter, while maintaining the plating efficiency of the bath at a constant, high level. Typically, at current densities within the range of about 10 to 100 amps per square decimeter, efficiencies within the range of about 70 to 90% are maintained over operating periods of several hundred hours.

DETAILED DESCRIPTION OF THE INVENTION

Because bath efficiency will begin to fall off almost as soon as the bath begins to be operated, it is important that an excess of free nitrite ions be present in the bath at the outset and maintained in the bath throughout the plating cycle. A water soluble palladium compound such as palladium diamine dinitrite, suitable as a source of palladium ions in the bath, while containing nitrite does not serve as a source of "free" nitrite because the nitrite remains complexed even after the compound is dissolved in the bath. Thus, it is necessary to include initially in the bath some other nitrite compound which is capable of dissociating in water to provide free, i.e., uncomplexed, nitrite ions.

Preferably, the source of free nitrite ions is a water soluble inorganic nitrite compound, and especially preferably an alkali metal nitrite, such as sodium nitrite, potassium nitrite, or the like and ammonium nitrite.

A small excess of nitrite ions is sufficient to maintain bath stability, usually at least about 0.05% by weight relative to the palladium ions in the bath. In most cases, the bath is formulated to provide an excess of free nitrite ions, initially, of from about 0.1 to about 50% by weight, relative to the palladium ions in the bath, with amounts of from about 0.5 to about 15% being preferred.

It is to be noted that, as the bath is operated and palladium is consumed by plating out, some of the free nitrite ions in the bath simultaneously undergo oxidation to the nitrate form. Thus, even if a large excess is provided in the bath initially, the free nitrite will eventually exhaust itself as the bath is operated. To ensure that an excess of free nitrite is maintained throughout plating, fresh amounts of the free nitrite source should be added to the bath from time to time. A convenient way of doing this is to add the nitrite compound to the bath with each periodic addition of the palladium compound used to replenish the palladium consumed. As a general rule, in each case the nitrite compound is added in an amount sufficient to provide from about 0.5 to about 15% by weight excess of nitrite ions relative to the palladium ions provided by the palladium compound.

The palladium is supplied to the bath, initially and upon replenishment, preferably in the form of a water soluble palladium (II) compound selected from among materials conventionally employed for such purposes in palladium electrodeposition baths. Examples include palladium diamine dinitrite [$Pd(NH_3)_2(NO_2)_2$] palladium chloride ($PdCl_2$), palladium sulfate, palladosamine chloride, diamine palladium hydroxide, tetramine palladium chloride and dichlorodiamine palladium chloride. Among these, palladium diamine dinitrite and palladium chloride are especially preferred for use in this invention.

The electrolyte for the bath may be any water soluble compound capable of dissolving in water to form an electrically conductive ionic medium. These may be selected from among the conventional materials. In the usual case, this is a water soluble nitrate compound, and preferably ammonium nitrate or an alkali metal nitrate, e.g., potassium nitrate or sodium nitrate.

The buffering agent that is included in the plating bath in its preferred embodiment may be any bath soluble material that will maintain the bath pH within the designed operating range of about 6.5 to 7.5. Typically, bath soluble inorganic compounds, such as borates, phosphates, and the like, are used, with the alkali metal and ammonium borates being particularly preferred.

The foregoing components may be formulated into an aqueous palladium electroplating bath for use in the present method, which has the following preferred ranges of such components:

| Ingredients | Amount, grams per liter |
|---|---|
| Water soluble palladium (II) compound, preferably palladium diamine dinitrite or palladium chloride | 10–60 grams per liter |
| Water soluble electrolyte compound, preferably alkali metal nitrate or ammonium nitrate | 85–95 grams per liter |
| Water soluble source of free nitrite, preferably alkali metal nitrite | 5–15 grams per liter |
| Water soluble buffering agent, preferably alkali metal or ammonium borate | 5–40 grams per liter |

Other ingredients may also be included in the compositions for their conventionally employed purposes. By way of illustration, such materials include brightening agents, wetting agents or surfactants, complexing agents for palladium ions, antioxidants, etc., all of which are well known to those skilled in the art.

In carrying out the electrodeposition process of the invention, the bath may be operated over a wide range of temperatures, such as from room temperature, e.g., 20° C., almost up to but below the boiling point of the bath, e.g., 100° C. Operating temperatures within the range of about 50°–70° C. are preferred.

Plating times will vary, depending on factors such as the supplied current density, bath temperature and palladium deposit thickness desired. For a current density in excess of about 10 amps per square decimeter and the preferred temperature range indicated above, i.e., 50°–70° C., a plating time of about 10 minutes or less is usually sufficient to yield a palladium deposit thickness of about 25 micrometers.

The bath pH may be adjusted before and/or during operation in the usual manner such as by addition of suitable amounts of an acid, e.g., nitric acid, or a base, e.g., ammonium hydroxide, to obtain and/or maintain the desired pH range of 6.5 to 7.5 with the preferred inclusion of the buffering agent in the bath, however, such adjustments are normally not required.

The present electroplating process is carried out using an insoluble anode. Any insoluble anode as is commonly used in precious metal electroplating is suitable. Typical of such insoluble anodes are those of platinum; platinized titanium, tantalum, or tantalum/-titanium alloys; titanium with ruthenium oxide or mixed ruthenium oxide-titanium oxide coatings and the like.

Electroplating is carried out at current densities that are typically at least 5–10 amps per square decimeter, although lower current densities, e.g., 1 amp per square decimeter may also be used. In many instances satisfactory results are obtained when using current densities as high as 100 amps per square decimeter, although operations, at about 10 to 50 amps per square decimeters are generally perferred.

By this invention, metallic palladium is deposited on the metallic cathode substrate as substantially smooth, bright and adherent layers. Examples of metal cathode surfaces on which palladium may be deposited include copper, nickel, silver and steel, as well as alloys of these such as brass, bronze, stainless steel or the like.

By practice in accordance with this invention, bath efficiencies of greater than 90% are provided and efficiencies of from 85 to 95% are typical even when the baths are operated over extended periods.

DESCRIPTION OF THE PREFERRED EMBODIMENTS

The invention is illustrated further in the following examples:

EXAMPLE 1

A small piece of flat copper is pretreated to remove any surface soils, pre-weighed and immersed in a palladium electrodeposition bath having the following composition;

| | |
|---|---|
| Palladium diamino dinitrite, $Pd(NH_3)_2(NO_2)_2$ | 50 grams/liter |
| Ammonium nitrate, $NH_4NO_3$ | 90 grams/liter |
| Sodium Nitrite, $NaNO_2$ | 10 grams/liter |
| Ammonium Biborate (NH4)2B4O7 | 25 grams/liter |
| Water | (to make 1 liter) |

A piece of platinized tantalum/titanium is immersed in the bath and connected as the anode to the positive side of a D.C. power supply unit. The copper piece is connected as the cathode to the negative supply of the D.C. power supply, and plating begins.

The bath has an initial weight ratio of nitrite ions to palladium ions of 1.5:1. The initial bath pH is between 6.5 to 7.5. The temperature of the bath is adjusted to and maintained at 70° C.

The current supply is regulated to deposit palladium at a current density of 30 amperes per square decimeter. At this current density, metallic palladium plates out on the surface of the copper workpiece at a rate of 28 milligrams per ampere-minute.

From time to time, the bath is replenished by adding more palladium diamine dinitrite in amounts so as to maintain the initial palladium concentration in the bath. Upon each addition of the palladium compound, the sodium nitrite is also added in an amount providing a 10% excess of the nitrite ion relative to the palladium ion of the diamine dinitrite compound.

A palladium deposit having a thickness of about 25 micrometers is obtained after about six minutes of operation. As computed from the known current density, plating time and palladium deposit thickness, the bath efficiency is found to be 85%.

Thereafter, plating is resumed and the consumable bath ingredients are periodically replaced in the bath in the manner previously described. In this way, the bath is operated continuously for several days with bath efficiency being maintained at or near 90%.

EXAMPLE 2

For purposes of comparison, the plating procedure of Example 1 is repeated except that fresh amounts of the nitrite compound are not added to the bath after operation has begun. It is observed that the bath efficiency begins to fall off after several hours and the amount of palladium being deposited per unit time decreases significantly.

EXAMPLE 3

A plating bath was made up with the following composition and concentrations in accordance with Example 1 of U.S. Pat. No. 4,092,225:

10 g/l Pd°
150 g/l Potassium Pyrophosphate
130° F. Temperature
pH-9 adjusted by pyrophosphate or potassium hydroxide.

This bath was used to electro plate on to copper coupons with good mechanical agitation at several different current densities as described in the patent, and the following results were obtained:

| Current Density (Amperes per square decimeter) | Cathode Efficiency % |
|---|---|
| 1 | 94 |
| 2 | 94 |
| 3 | 94 |
| 4 | 94 |
| 5 | 77 |

When higher current densities were used, there was a very rapid decrease in cathode efficiency and at current densities of 6–7 amperes per square decimeter, exfoliation of the deposit occurs which makes the actual cathode efficiency unmeasurable.

EXAMPLE 4

By comparison, the procedure of Example 1 was repeated at several different current densities and the following results were obtained:

| Current Densities (Amperes per square decimeter) | Cathode Efficiency % |
|---|---|
| 5 | 97 |
| 10 | 88 |
| 20 | 88 |
| 30 | 85 |
| 40 | 70 |
| 50 | 72 |
| 60 | 68 |
| 70 | 68 |
| 80 | 72 |
| 90 | 68 |
| 100 | 72 |

EXAMPLE 5

The procedure of Example 1 is repeated except that the ammonium biborate is not included in the plating bath. The bath pH is adjusted to within the range of 6.5 to 7.5 by the addition of nitric acid and is maintained within this range by further nitric acid additions during plating. Using this procedure, similar results are obtained.

From the above, it is apparent that not only does the method of the present invention provide high bath efficiencies over prolonged periods of operation, but additionally, the current density at which such efficiencies are obtained is extended at least twenty fold as compared with prior art baths and processes. These results are not obtained, however, unless the prescribed excess of nitrite ions are maintained during the plating process.

In this regard, it is to be noted that heretofore, the art has not recognized the necessity of maintaining this excess of nitrite ions. For example, in U.S. Pat. No. 1,993,623, a palladium plating process is described in which the plating bath is formulated by reacting palladium chloride with sodium nitrite, the amount of the latter being from about 4 grams per liter below to 4 grams per liter above the theoretical amount necessary to react with all of the palladium. Thereafter, the bath is electrolyzed using soluble palladium anodes. There is no recognition in this patent, which is typical of the prior art, of the criticality of maintaining, or even starting with, an excess of nitrite. Moreover, by the use of soluble palladium anodes, no separate replenishment of the bath components is carried out, thus indicating that maintenance of the nitrite concentration at the original make-up level was not contemplated.

It has been found that when an aqueous solution of sodium nitrite was electolyzed at 3 volts for 4 hours there was a loss of sodium nitrite from the solutions at the rate of 2 grams per liter per ampere hour. This clearly shows that in the process of U.S. Pat. No. 1,993,623, which is operated without separate replenishment, even with 4 grams per liter excess sodium nitrite, such excess would be quickly depleted with the resulting decrease in efficiency shown above.

Other modifications and variations of the invention will suggest themselves to those skilled in the art in view of the description. It is to be understood, therefore, that changes may be made in the specific embodiments described without departing from the scope and principles of the invention as defined in the appended claims, and without sacrificing its chief advantages.

What is claimed is:

1. A process for the electrodeposition of palladium which comprises electrolyzing an aqueous plating bath which has a pH of from 6.5 to 7.5 and which contains a bath-soluble palladium compound, an electrolyte compound, and a nitrite compound in an amount sufficient to provide an excess of free nitrite ions relative to the palladium ions in the bath, by passing an electric current through said bath, between an anode which is insoluble in the bath and a cathode, at a current density of at least 5 $A/dm^2$, and continuing said passage of current while maintaining said excess of free nitrite ions in the bath until the desired electrodeposition of palladium is obtained on the cathode.

2. The process as claimed in claim 1, wherein a buffering agent is included in the bath.

3. The process as claimed in claim 2 wherein the excess of free nitrite ions maintained in the bath is from about 0.5 to 15% by weight relative to the palladium ions.

4. The process as claimed in claim 1 wherein the excess of free nitrite ions maintained in the bath is from about 0.5 to 15% by weight relative to the palladium ions.

5. The process as claimed in claims 2, 3, or 4 wherein the bath contains the following components in the amounts indicated:

| | |
|---|---|
| Water soluble palladium II compound | 10–60 grams per liter |
| Water soluble electrolyte compound | 85–95 grams per liter |
| Water soluble nitrite compound | 5–15 grams per liter |
| Water soluble buffering agent | 5–40 grams per liter |

* * * * *